United States Patent [19]

Ostendorf

[11] Patent Number: 4,885,971

[45] Date of Patent: Dec. 12, 1989

[54] MUSICAL WIND INSTRUMENT

[76] Inventor: Philip J. Ostendorf, 1047 Mariner Dr., Key Biscayne, Fla. 33149

[21] Appl. No.: 300,038

[22] Filed: Jan. 19, 1989

[51] Int. Cl.[4] ..... G10D 7/10

[52] U.S. Cl. ..... 84/387; 84/396

[58] Field of Search ..... 84/330, 387–401

[56] References Cited

U.S. PATENT DOCUMENTS

| | | | |
|---|---|---|---|
| D. 69,905 | 4/1926 | Mussehl | 84/387 R X |
| 814,615 | 3/1906 | Meredith | 84/388 |
| 970,136 | 9/1910 | Teste | 84/387 |
| 1,122,207 | 12/1914 | Kloepfel | 84/387 |
| 3,529,505 | 9/1970 | Brooks | 84/387 R |
| 4,127,050 | 11/1978 | Takeuchi | 84/387 |
| 4,516,464 | 5/1985 | Hastings | 84/387 R |

FOREIGN PATENT DOCUMENTS

| | | | |
|---|---|---|---|
| 471762 | 2/1929 | Fed. Rep. of Germany | 84/395 |
| 47280 | 6/1909 | Switzerland | 84/387 R |
| 2559 | 10/1861 | United Kingdom | 84/387 R |
| 235083 | 6/1925 | United Kingdom | 84/387 |
| 2766 | 12/1958 | United Kingdom | 84/387 |

OTHER PUBLICATIONS

Sadie, "The New Grove Dictionary of Musical Instruments", MacMillan Press Ltd., London, 1984, pp. 637, 722, 723 and 724, title and copyright page included.

Montagu, "The World of Romantic & Modern World Instruments", The Overlook Press, Woodstock, N.Y., 1981, pp. 76 through 81 and 92–94, title and copyright page included.

*Primary Examiner*—Lawrence R. Franklin

*Attorney, Agent, or Firm*—Roger S. Dybvig

[57] ABSTRACT

A musical instrument which may be used to play a complete major scale without coordinated mouth and finger operations is formed as two or three horns having a single, shared mouthpiece, and pitched one or two half tones apart. One or both the of the horns may have one or two ports to enable one to play a complete major scale and other scale notes.

17 Claims, 3 Drawing Sheets

MUSICAL WIND INSTRUMENT

BACKGROUND OF THE INVENTION

This invention relates broadly to wind operated musical instruments and particularly to those musical instruments which are resonant in response to vibrating air columns induced therein to produce tones of various different pitches.

Conventional wind instruments may be categorized in accordance with the manner in which a vibrating air column is induced in them. Thus, there are lip reed instruments, examples of which include trumpets, cornets, trombones, french horns, and bass horns; reed instruments, examples of which include clarinets, saxophones, oboes, and bassoons; and split-air-stream instruments, examples of which include piccolos and flutes.

In each of the above-mentioned instruments, as well as in many other instruments, sound vibrations are created at an inlet or mouthpiece and these sound vibrations are channeled through an elongated instrument tube whose effective length is configured, that is lengthened or shortened, to create resonance therein so as to amplify the sound vibrations and promulgate them to the surrounding area. The original sound vibrations at the mouthpiece are created in different ways for different instruments. For the lip reed instruments, the vibrations are created by vibrating lips whereas for the reed instruments the vibrations are caused by single or double reeds. For the split-air-stream instruments, air is caused to vibrate by passing over air-splitting baffle edges. In each of these instruments, a musician can control these initial vibrations with mouth activity by controlling the quantity, velocity and/or direction of air flow, by the position of the lips, etc. By using mouth control, a musician can control to a great extent musical sounds which exit from a musical wind instrument, and in this regard, some instruments, such as a bugle, are played totally by mouth control. However, mouth control related to a single effective air column length is somewhat limited and does not allow a full range of musical notes.

The frequencies of the vibrations at which an instrument is resonant depend upon the length of the instrument, that is, the length of the tube between its air inlet and its air outlet. This length determines, but is not quite equal to, the effective length of the air column in which the sound waves are formed that, at certain frequencies, cause the instrument to resonate and thereby amplify the sound output of the instrument. It is well known that, to resonate at any given frequency, an instrument must have an effective air column equal in length to an integer multiple of one-half of the wave length of that frequency. This forms the basis for the so-called "harmonic series" of notes that can be resonant and amplified by an instrument having an air column of a given effective length, which series may be expressed by the series of fractions ½, 2/2, 3/2, 4/2 . . . n/2, wherein the numerator represents the number of one-half waves formed in the air column.

The common bugle has a single fixed length and is therefore capable of resonating only at frequencies within a single harmonic series. It cannot be used to produce a complete major or minor scale. In order to extend the range of the several instruments mentioned above, so that they may be used to produce not only major and minor scales but also complete chromatic scales, the instruments are provided with mechanisms to change the tube and effective air column lengths. Such mechanisms usually comprise telescoping slides, openable ports, or depressible or rotatable valve keys to provide openings to differing combinations of tubing sections. Because of the ability to change the effective air column lengths, the instruments can be used to produce multiple sets of harmonic series and thereby to produce complete chromatic scales.

The frequency, and therefore the pitch, of vibration of a wind instrument depends upon the frequency of the input to instrument. Typically, a wind instrument, including its mouthpiece, is so constructed that one may produce frequencies beginning with the first or second harmonic number and, depending upon the skill of the musician, extending upwardly through several harmonic numbers. One may change the inlet openings so that the frequencies produced tend to be in the higher harmonic ranges. For example, an instrument made by equipping a bass horn with a conventional trumpet mouthpiece may not be usable to play the lower harmonics but could be used for playing higher harmonics than can be obtained using a conventional bass horn mouthpiece. This is because the bass horn mouthpiece is designed to enable one to vibrate the lips at lower frequencies than possible with a trumpet mouthpiece, at the expense of higher frequencies available using a trumpet mouthpiece.

As those skilled in the art are aware, the number of scale notes between the members of a harmonic series decreases as the harmonic number increases. This phenomena is demonstrated by the following Table I, which is for a trombone having an effective air column length of 9.43 feet. (This Table I and Table II and Table III below are calculated using an assumed speed of sound of 1100 feet per second which is not quite accurate but is sufficient for purposes of understanding this invention.)

TABLE I

| Harmonic | Pitch | Wave Length | Scale Frequency |
|---|---|---|---|
| 2/2 | A# | 9.43 feet | 116.54 cps |
| | B | | 123.41 |
| | C | | 130.81 |
| | C# | | 137.59 |
| | D | | 146.83 |
| | D# | | 155.56 |
| | E | | 164.81 |
| 3/2 | F | 6.29 | 174.61 |
| | F# | | 185.00 |
| | G | | 196.00 |
| | G# | | 207.65 |
| | A | | 220.00 |
| 4/2 | A# | 4.72 | 233.08 |
| | B | | 246.94 |
| | C | | 261.63 |
| | C# | | 277.18 |
| 5/2 | D | 3.78 | 293.66 |
| | D# | | 311.13 |
| | E | | 329.63 |
| 6/2 | F | 3.15 | 349.23 |

One may observe that a trombone with an effective air column of 9.43 feet is capable of playing notes of ascending pitch in the sequence A#, F, A#, D, and F. Of course, a trombone usually has a slide for increasing the length of its effective air column so that other harmonic series can be formed. One may also observe from Table I that there are six scale notes between harmonic 2/2 and 3/2, four scale notes between harmonic 3/2 and 4/2, three scale notes between harmonic 4/2 and 5/2, and only two scale notes between 5/2 and 6/2. If the harmonic number is raised high enough, an instrument will play adjacent half tone notes. (At even higher harmonics, an instrument would play quarter tones.)

A problem with musical wind instruments capable of playing complete scales is that they require considerable skill, patience, and practice to play. Not only must musicians be dexterous with their fingers to reconfigure the instrument tubes, they must also memorize all of the proper positions and coordinate them with their lip movements.

An object of this invention to provide a musical wind instrument which may be used to play more notes than possible with a conventional instrument having a fixed tube length but which is simpler to play than conventional wind instruments having mechanisms for changing their tube lengths. More particularly, it is an object of this invention is provide a musical wind instrument which may be used to play a complete major scale without coordinated mouth and finger operations.

Another object of this invention is to provide a musical wind instrument which may be used to produce a complete chromatic scale with a minimum of coordinated mouth and finger operations.

Another object of this invention is to provide such a musical wind instrument which has a reasonably acceptable tone quality.

A musical wind instrument in accordance with one embodiment of this invention comprises a mouthpiece, an energy divider extending from the mouthpiece that divides the sound energy entering the mouthpiece into two or three streams, a tubing assembly for each of the streams connected to outlets from the energy divider, the tubing assemblies having open distal or free ends, one or all of which may terminate in bells. Each tubing assembly optionally and preferably includes a fixed-length body and a tuning slide. The different tubing assemblies are of respectively different lengths so that they resonate at different frequencies and thus may be used to produce more musical notes than possible with a single, fixed-length instrument.

In accordance with the presently preferred embodiment of this invention, the instrument is formed as two horns with a single inlet, with the length of one horn having a fundamental (harmonic 2/2) which is one half tone above the fundamental of the other horn. Other workable embodiments may have two horns having a difference in their respective fundamentals of two half tones. Still other embodiments may include a third horn having an inlet opening common with the other two horns, the third horn having a fundamental which is higher, again by one or two half tones, than the higher of the other two horns.

In a preferred practice of this invention, a mouthpiece is used which enables the two horns to be played without substantial difficulty in a range of frequencies beginning at the 4/2 harmonic and extending through the 12/2 harmonic. It will be demonstrated that such an instrument with two horns can play a complete major scale and several additional scale tones.

Further in accordance with embodiments of this invention, one or more of the plural horns is provided with one or more normally closed ports adjacent their distal or free ends.

Many combinations may be used to produce a musical wind instrument in accordance with this invention - either two or three horns, pitched one or two half tones apart, with no ports or with either one or two ports. Each combination would have its own set of advantages and disadvantages. The presently preferred embodiment of this invention comprises two horns of different length having a single, shared air inlet, the shorter horn having a fundamental that is one half tone higher than the longer horn, and the shorter horn having two ports spaced from its distal end by lengths such that the opening of the port nearest the distal end of the shorter horn will raise its fundamental by one half tone. The second port is used to adjust the pitch of certain scale notes and raise the fundamental of the shorter horn by an additional approximate half tone. However, the second port may optionally be omitted, particularly for the sake of simplicity, but with some loss of quality.

An important aspect of this invention is in connection with the energy divider. The divider has a single inlet branch opening to the mouthpiece and is split into either two or three outlet branches. It should be so constructed and located that the sound energy input provided by a musician playing the instrument is evenly divided as closely as practicable to the mouthpiece. Since the divider converts the single inlet branch into two or three outlet branches, it must necessarily expand in diameter and cross-sectional area. The expansion in cross-sectional area should be uniform and gradual.

In accordance with another embodiment of this invention, only one of the horns terminates in a bell. The other horn or horns could simply end, without expansion, as a tube. Also, optionally one horn could have conical tubing and the other horn or horns could have cylindrical tubing, or vice versa. In the case of a split-air-stream horn, all of the tubing sections could be cylindrical throughout their length. One caveat is that the frictional resistance to air being blown through each of the horns should be essentially equal; otherwise, the air will tend to follow the path with least resistance and provide inadequate sound energy to any horn having relatively greater air resistance.

Other objects and advantages will become apparent from the following description and the drawings.

DETAILED DESCRIPTION

Figure 1:
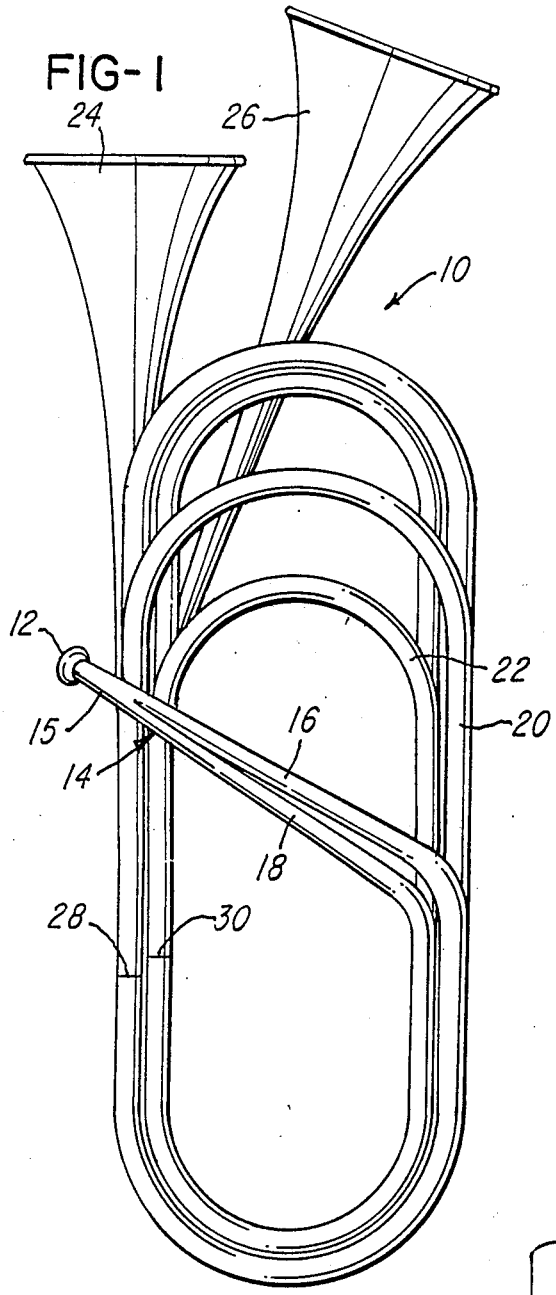
FIG. 1 is an elevational view of a musical wind instrument in accordance with one embodiment of this invention.

A first embodiment of a musical wind instrument 10 in accordance with this invention is shown in FIG. 1 to comprise a single inlet in the form of a cup-shaped mouthpiece 12, an energy divider 14 having a proximal end comprising a tubular inlet branch 15 extending from and opening to the mouthpiece 12 that divides the sound energy entering the mouthpiece 12 into two streams that pass respectively through two tubular outlet branches 16 and 18, a first tubing assembly 20 having a proximal end connected and opening to the distal end of the outlet branch 16, and a second tubing assembly 22 having a proximal end connected and opening to the distal end of the outlet branch 18. Bells 24 and 26 are formed at the distal ends of the first and second tubing assemblies 20 and 22, respectively.

The energy divider 14 must be as close as reasonably possible to the mouthpiece and must have a limited rate of expansion or cross-sectional enlargement. If the divider 14 is too far from the mouthpiece 12, it will form a ratio with the balance of the tubing as a result of which numerous pitches will be filtered out. If it expands too rapidly, the instrument's pitches will be limited to the frequency corresponding to the half wave length of the position of the rapid enlargement. An expansion at a rate of one square inch in cross section for each five inches in length is acceptable.

Each tubing assembly 20 and 22 comprises a length of hollow tubing that may be either cylindrical or conical, or partly cylindrical and partly conical, depending upon the timbre desired. Lines of demarcation 28 and 30 are shown between the energy divider 14 and the tubing assemblies 22 and 24. However, it should be understood that the locations of the demarcation lines 28 and 30 are entirely arbitrary. In fact, the branches 16 and 18 of the energy divider 12 and the tubing assemblies 22 and 24, respectively, may be integrally joined together. To enable convenient handling of the instrument 10, the second divider branch 18 and the second tubing assembly 18 are coiled partly within a coil formed by the first divider branch 16 and the first tubing assembly 20.

It may be appreciated that the instrument 10 is formed as two horns with a single mouthpiece 12. The first horn comprises the mouthpiece 12, the divider inlet branch 15, the first divider outlet branch 16, and the tubing assembly 20 with its bell 24. The second horn comprises the mouthpiece 12, the divider inlet branch 15, the second divider outlet branch 18, and the tubing assembly 22 with its bell 26. In accordance with the principles mentioned above, the length of the second horn preferably is such as to produce a fundamental (harmonic 2/2) which is one half tone above the fundamental of the first horn. However, other workable embodiments may have differences in the horn fundamentals of two half tones.

By proper selection of the mouthpiece 12, the instrument 10 may be used to play a major scale, and other scale frequencies, without the use of any mechanisms to change the effective lengths of the air columns produced by the two horns. Accordingly, one may, by trial and error, learn to play several scale notes including a complete major scale simply by proper control of the lip vibration or "lip buzz" input to the mouthpiece 12.

The lengths of the horns made in accordance with this invention are not critical so long as they provide effective air column lengths which will result in usable notes for the music intended to be played. In other words, the lengths of the horns will be so selected that they resonate at frequencies which produce usable scale notes. An example of a musical wind instrument having a longer horn with an effective air column length of 9.43 feet and a shorter horn with an effective air column length of 8.91 feet is discussed in connection with Table II below. The length of 9.43 feet is used in Table II for convenient comparison with Table I.

Table II is based upon horns operating in the range from the 4/2 harmonic through the 20/2 harmonic. However, a feasible operating range begins with a 4/2 harmonic and extends through the 12/2 harmonic. More conventional horns having air column lengths of approximately 9 feet would be generally in the trombone range and would use a trombone mouthpiece. However, it would be practically impossible if not impossible for even a highly skilled musician using a trombone mouthpiece to play harmonics as high as 10/2 to 12/2. For purposes of this invention, a mouthpiece for an instrument having air column lengths of approximately 9 feet would be similar to and could be a trumpet mouthpiece, and the diameter of the tubing forming the instrument of this invention would have a diameter more on the order of tubing used to form conventional trumpets than tubing used to form conventional trombones. Similarly, an instrument 10 made in accordance with this invention using tubing normally used for producing trombones and a trombone mouthpiece would be longer than conventional trombone tubing. Such an instrument having one horn which is approximately 14 feet long and a second horn approximately 13.5 feet long and used with a trombone mouthpiece has been found to have a reasonably acceptable tone quality, at least for educational purposes or for personal pleasure.

Instrument 10, and the other instruments described herein, may be made from a suitable plastic or metal. Techniques of construction used for manufacturing conventional trumpets, baritone horns, and the like may be adopted for manufacturing the instruments of this invention, and therefore are not described herein. The mouthpiece 12 may be entirely conventional.

Figure 2:
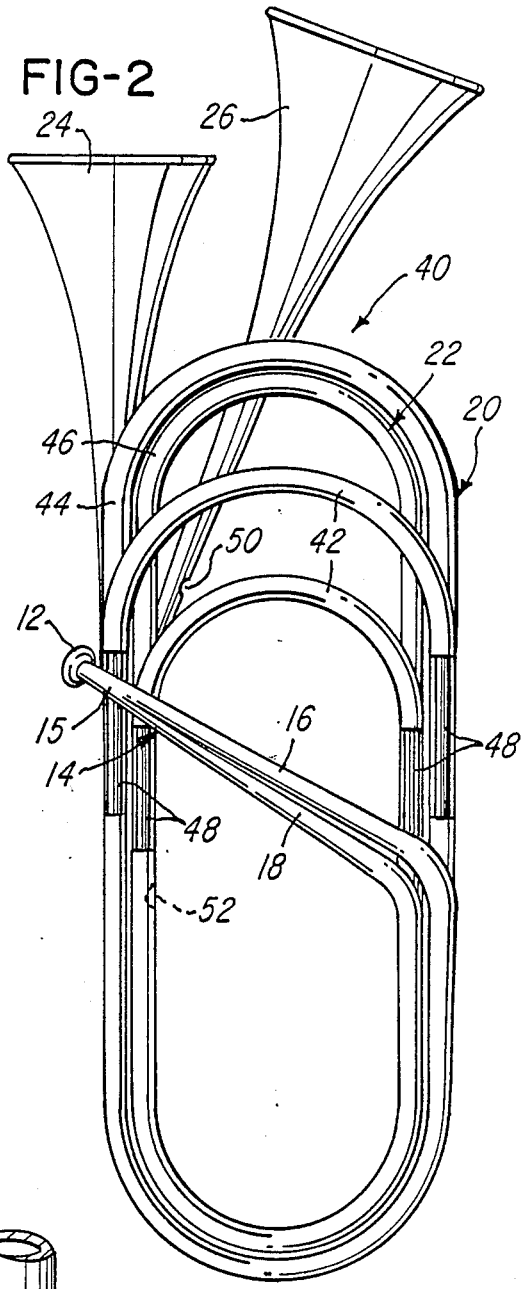
FIG. 2 is an elevational view of a musical wind instrument in accordance with a second, and presently preferred, embodiment of this invention.
Figure 3:
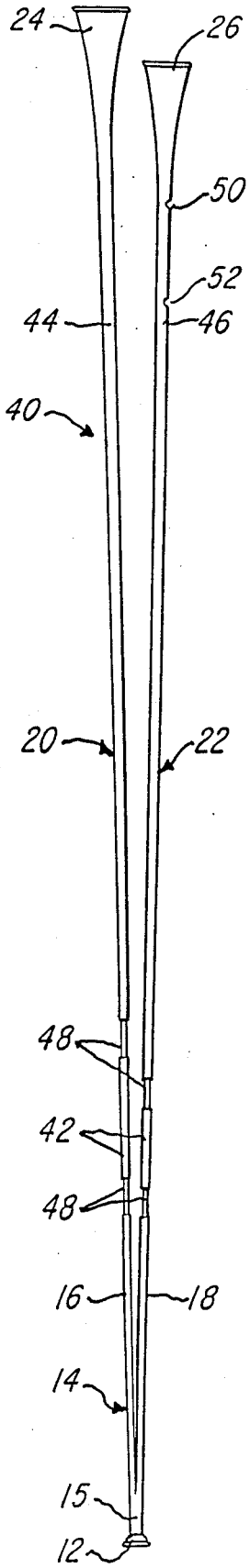
FIG. 3 is a diagrammatic view of the instrument of FIG. 2 shown as if unbent from the shape shown in FIG. 2.

FIGS. 2 and 3 illustrate a second, and presently preferred, embodiment of a wind musical instrument, generally designated 40. In FIG. 2, and the other figures, like parts are identified by the same reference numbers used in FIG. 1. Instrument 40 comprises an energy divider 14 having an inlet branch extending from and opening to the mouthpiece 12 that divides the sound energy entering the mouthpiece 12 into two streams that pass through outlet branches 16 and 18, a first tubing assembly, generally designated 20, having a proximal end connected and opening to the distal end of the branch 16, and a second tubing assembly, generally designated 22, having a proximal end connected and opening to the distal end of the branch 18. Bells 24 and 26 are formed at the distal ends of the first and second tubing assemblies, respectively.

The instrument 40 of FIGS. 2 and 3 differs from the instrument 10 of FIG. 1 in two respects. First, the tubing assemblies 16 and 18 include U-shaped tuning slides 42 and fixed-length tubing bodies 44 and 46, respectively. Tubing body 46 is shorter than tubing body 44 so that the horn of which it forms a part has a fundamental higher than the fundamental of the horn formed with the longer tubing body 44. Tuning slides 42 have reduced diameter end sections 48 that are slidably received in the distal ends of the divider branches 16 and 18 and the proximal ends of the tubing bodies 44 and 46. This construction, as is well known, enables both of the horns formed by the instrument 40 to be tuned for the conditions under which the instrument 40 is being played.

Instrument 40 further differs from instrument 10 by the provision of a pair of ports 50 and 52 near the distal end of the shorter tubing body 46. When using the instrument 40, the ports 50 and 52 may be closed by the fingers of the musician playing the instrument and selectively opened while it is being played. Optionally, mechanisms such as conventional spring-biased, lever-like keys (not shown) for normally closing the ports 50 and 52 may be mounted on the tubing body 46. The port 50 is so located that its opening 50 raises the fundamental of the shorter horn by a half tone. The port 50 is preferably as close to the distal end of the tubing secion 16 as possible to minimize the change in timbre between the horn when ported and when not ported. The second port 52 is so spaced from the port 50 that it may be opened to produce another effective column for adjusting the pitch of off-key notes, and has a fundamental approximately one half tone higher than the fundamental produced by the opening of the port 50.

Table II below shows the frequencies at which a horn 40 made in accordance with this invention may resonate. As noted above, Table II assumes that the longer horn length is such that its effective air column length is 9.43 feet and its shorter horn has an effective air column length of 8.91 feet. It may be noted that Table II demonstrates how one may play a complete chromatic scale, and other scale notes, using the horn 40. It may also be noted that the port 50 need only be opened to produce "accidentals" - sharps or flats required for key changes or for non-major scale tones in a composition. The first column of Table II, which column has no heading, contains the scale indicators, "Do, Re, Mi" etc., to demonstrate that the unported horn 10 of FIG. 1 may be used to produce a complete major scale and other major scale notes. Table II does not include a column for the second port 52, such being provided optionally to adjust other pitches. Its precise characteristics will depend upon the preferences of the manufacturer and will be determined by trial and error.

The column titled "AVERAGE" is provided because experience has shown that frequencies that appear to be averaged are occasionally obtained in those cases at the higher harmonics where the natural harmonic frequencies of the two horns are quite close.

Here it may be noted that the harmonics 13/2 through 20/2, although included in Table II, may be of theoretical interest only since one using a mouthpiece and tubing combination with which harmonics 4/2 through 12/2 may relatively easily be played would find it exceedingly difficult or impossible to play the higher harmonics.

Figure 7:
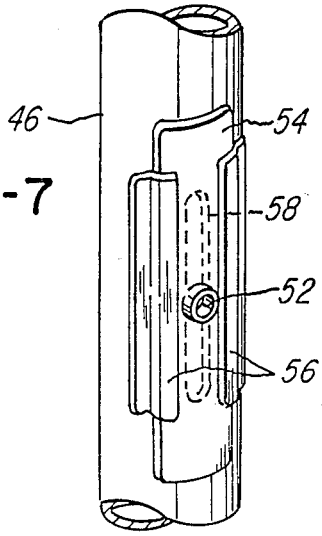
FIG. 7 is a fragmentary perspective view of a portion of a musical wind instrument in accordance with the invention in which the instrument is provided with an adjustable port.

Although not all scale notes achieved by the instrument 40 are precisely on pitch, the variants from true pitch are small and may be adjusted, as indicated above, by the second port 52. Further to this end and with reference to FIG. 7, the position of the port 52 may be made effectively adjustable by locating it in a manually slidable plate 54 frictionally retained and guided by gibs 56. As is apparent, the ported plate 54 is slidable over a portion of the tubing body 46 which is provided with an elongated slot 58. As will be readily understood, the adjusted position of the port 52 will determine the effective length of the air column created when the port 52 is opened while the instrument 40 is being played. Of course, the port 50 could be made adjustable in the same manner.

As another embodiment, it will be apparent that the simple instrument 10 of FIG. 1 could be provided with ports in the same manner and for the same purpose as the ports 50 and 52 of the instrument 40 of FIGS. 2 and 3.

FIG. 3 is included to diagrammatically show the complete horn 40 as if it were unbent from the coiled configuration shown in FIG. 2. Here it may be noted that the shorter horn terminating in the bell 26 appears in FIG. 2 to have a longer length because it is coiled more tightly than is the longer horn terminating in the bell 24.

TABLE II

| | HORN 1 Harmonic | | HORN 2 Harmonic | | PORT Harmonic | | AVERAGE | PITCH | SCALE FREQUENCY |
|---|---|---|---|---|---|---|---|---|---|
| | 4/2 | 233.08 | | | | | | A# | 233.08 |
| | | | 4/2 | 246.94 | | | | B | 246.94 |
| | | | | | 4/2 | 261.62 | | C | 261.62 |
| | | | | | | | | C# | 277.18 |
| | 5/2 | 291.35 | | | | | | D | 293.66 |
| La | | | 5/2 | 308.68 | | | | D# | 311.12 |
| | | | | | 5/2 | 327.03 | | E | 329.62 |
| Ti | 6/2 | 349.62 | | | | | | F | 349.23 |
| Do | | | 6/2 | 370.41 | | | | F# | 370.00 |
| | | | | | 6/2 | 392.43 | | G | 392.00 |
| Re | 7/2 | 407.89 | | | | | | G# | 415.30 |
| | | | 7/2 | 432.15 | | | | A | 440.00 |
| Mi | 8/2 | 466.16 | | | 7/2 | 457.84 | | A# | 466.16 |
| Fa | | | 8/2 | 493.88 | | | | B | 493.88 |
| | 9/2 | 524.43 | | | 8/2 | 523.24 | | C | 523.25 |
| So | | | 9/2 | 555.62 | | | | C# | 554.36 |
| | 10/2 | 582.70 | | | 9/2 | 588.65 | | D | 587.82 |
| La | | | 10/2 | 617.35 | | | | D# | 622.25 |
| | 11/2 | 640.97 | | | 10/2 | 654.05 | | E | 659.25 |
| Ti | 12/2 | 699.20 | 11/2 | 679.08 | | | 689.14 | F | 698.45 |
| Do | 13/2 | 757.51 | 12/2 | 740.82 | 11/2 | 719.46 | 749.17 | F# | 739.98 |
| | | | 13/2 | 802.56 | 12/2 | 784.86 | | G | 783.98 |
| Re | 14/2 | 815.78 | | 802.56 | 13/2 | 850.27 | 809.17 | G# | 830.60 |
| | 15/2 | 874.05 | 14/2 | 864.29 | | | | A | 880.00 |
| Mi | 16/2 | 932.32 | 15/2 | 926.03 | 14/2 | 915.67 | 929.18 | A# | 932.32 |
| Fa | 17/2 | 990.59 | 16/2 | 987.76 | 15/2 | 981.08 | 989.18 | B | 987.76 |
| | 18/2 | 1048.86 | 17/2 | 1049.50 | 16/2 | 1046.48 | | C | 1046.49 |
| So | 19/2 | 1107.13 | 18/2 | 1111.23 | 17/2 | 1111.89 | 1109.18 | C# | 1108.72 |
| | 20/2 | 1165.40 | 19/2 | 1172.97 | 18/2 | 1177.29 | | D | 1174.65 |

Figure 4:
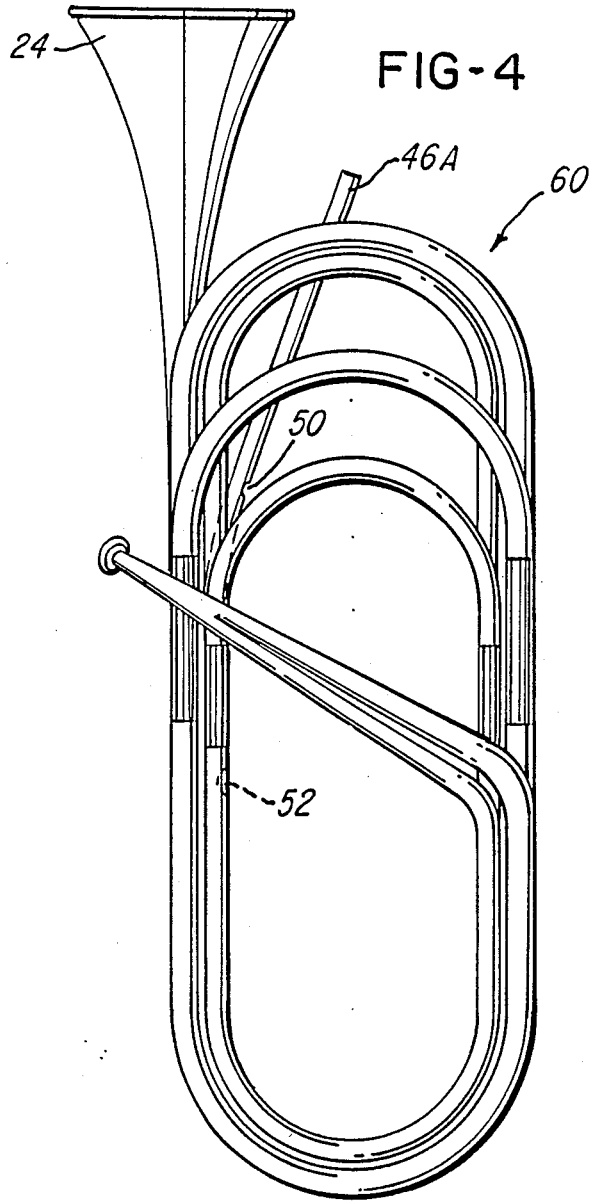
FIG. 4 is an elevational view of a musical wind instrument in accordance with a third embodiment of this invention.

In the embodiment of FIG. 4, an instrument 60 is provided which differs from the instrument 40 of FIGS. 2 and 3 in that the shorter tubing body 46A does not terminate in a bell but rather terminates as a simple tube. Tubing 46A is shorter than the corresponding tubing body 46 of FIGS. 2 and 3 because of the differences in characteristics between bell-terminated and tube-terminated horns. The tube terminating end may be left open or closed by the musician's finger, causing either an open tube pitch or a lower, closed-tube, reflective pitch. The difference in these pitches is very nearly one half tone which provides chromatic capability. The reason for this shift is due to the difference in air column length created by a closed tube and that created by an open tube.

The instrument 60 of FIG. 4 also has normally-closed ports 50 and 52 in the tube-body 46A by which additional notes may be obtained, the port 50 functioning the same as the ports 50 and 52 of FIGS. 2 and 3.

Figure 5:
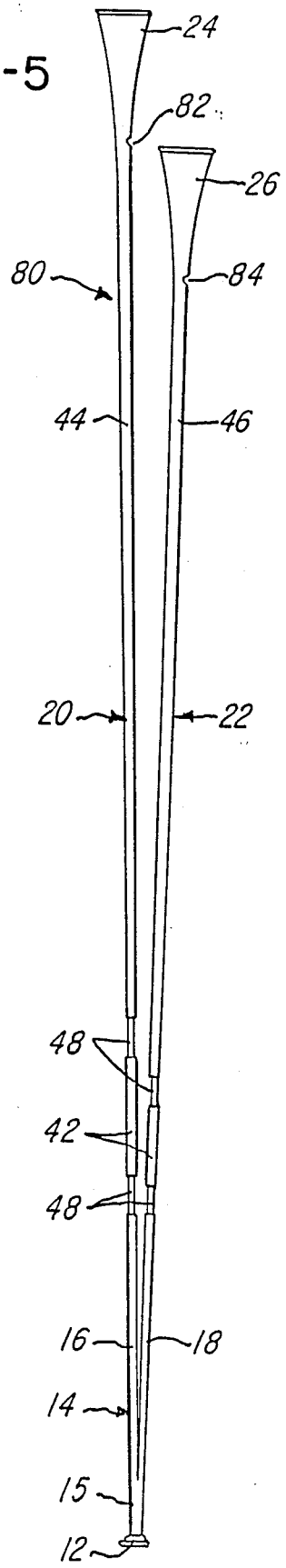
FIG. 5 is a diagrammatic view similar to FIG. 3 but showing a musical wind instrument in accordance with a fourth embodiment of this invention.

FIG. 5 shows a musical wind instrument 80 with an energy divider 14 with a single inlet branch 15 and two outlet branches 16 and 18, connected respectively to two tubing assemblies 20 and 22 effectively to form two horns of different lengths having a single mouthpiece 12. This embodiment differs from the embodiments of FIGS. 2 and 3 in that the respective fundamentals of the two horns differ by two half tones and each horn is provided with a port, designated 82 and 84 respectively, located adjacent the distal ends of the tubing assemblies 20 and 22. Provided that the ports 82 and 84 when opened lower the fundamentals of the two horns by one half tone each, the following Table III demonstrates the characteristics of the instrument 80. Again, it is assumed that the longer horn has an effective air column length of 9.43 feet. The shorter horn in this case has an effective air column length of 8.41 feet.

TABLE III

| | HORN 1 Harmonic | | PORT 1 Harmonic | | HORN 2 Harmonic | | PORT 2 Harmonic | | PITCH |
|---|---|---|---|---|---|---|---|---|---|
| Fa | 4/2 | 233.08 | | | | | | | A# |
| | | | 4/2 | 246.94 | | | | | B |
| So | | | | | 4/2 | 261.62 | | | C |
| | | | | | | | 4/2 | 277.18 | C# |
| La | 5/2 | 291.35 | | | | | | | D |
| | | | 5/2 | 308.68 | | | | | D# |
| Ti | | | | | 5/2 | 527.03 | | | E |
| Do | 6/2 | 349.62 | | | | | 5/2 | 346.47 | F |
| | | | 6/2 | 370.41 | | | | | F# |
| Re | | | | | 6/2 | 392.43 | | | G |
| | 7/2 | 407.89 | | | | | 6/2 | 415.77 | G# |
| Mi | | | 7/2 | 432.15 | | | | | A |
| Fa | 8/2 | 466.16 | | | 7/2 | 457.84 | | | A# |
| | | | 8/2 | 493.88 | | | 7/2 | 485.07 | B |
| So | 9/2 | 524.43 | | | 8/2 | 523.24 | | | C |
| | | | 9/2 | 555.62 | | | 8/2 | 554.36 | C# |
| La | 10/2 | 582.70 | | | 9/2 | 588.65 | | | D |
| | | | 10/2 | 617.35 | | | 9/2 | 623.65 | D# |
| Ti | 11/2 | 640.97 | | | 10/2 | 654.05 | | | E |
| Do | 12/2 | 699.20 | 11/2 | 679.08 | | | 10/2 | 692.95 | F |
| | | | 12/2 | 740.82 | 11/2 | 719.46 | | | F# |
| Re | | | | | 12/2 | 784.86 | 11/2 | 762.25 | G |
| | | | | | | | 12/2 | 831.55 | G# |

Figure 6:
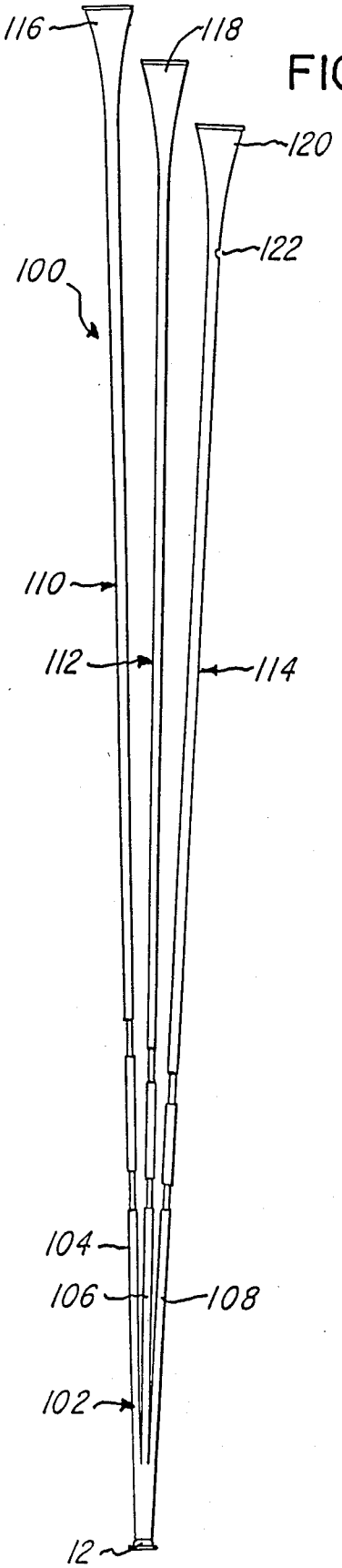
FIG. 6 is a diagrammatic view similar to FIG. 3 but showing a musical wind instrument in accordance with a fifth embodiment of this invention.

FIG. 6 shows a musical wind instrument 100 with an energy divider 102 having three outlet branches 104, 106, and 108, connected respectively to three tubing assemblies 110, 112, and 114 effectively to form there horns of different lengths having a single mouthpiece 12. All three tubing assemblies are shown terminating in horns designated 116, 118, and 120. However, one or two of the tubing assemblies could terminate in unexpanded tubes. The shortest tubing assembly 114 may be ported as shown at 122. As with the previous embodiments, the three horns may have fundamentals differing by one or two half tones from one another. This embodiment may not offer significant advantages over the two-horn embodiments, but may be useful for some purposes. Three horns is the upper limit because an instrument with four or more horns would cause an unacceptable division of the energy supplied by the musician so they would likely not be playable. Also, with four or more horns using a single mouthpiece, many unusable notes would be produced and some usable notes would likely be cancelled out.

As mentioned above, the frictional resistance to air being blown through each of the horns forming an instrument of this invention should be essentially equal. If not, the air will tend to follow the path with least resistance and provide inadequate sound energy to any horn having relatively greater air resistance. To obtain equal friction will require experimentation. In general, the air resistance of a horn can be modified by changing the diameter of the tubing to the length of the horn. Accordingly, the diameters of the tubes can be changed to adjust their resistance to air movement.

While the embodiments of the invention illustrated herein are all lip reed instruments, it will be apparent that the invention is applicable to reed instruments and to split-air-stream instruments. One can readily appreciate, for example, that the mouthpiece 12 could readily be modified to accept a reed or to function as a split-air-stream instrument.

Although the presently preferred embodiment of this invention has been described, it will be understood that within the purview of this invention various changes may be made within the scope of the following claims.

Having thus described my invention, I claim:

1. A musical wind instrument comprising:

a mouthpiece;

energy divider means having a single inlet branch opening to said mouthpiece and plural outlet branches, not exceeding three in number, opening to said inlet branch for dividing the sound energy input to said mouthpiece into plural streams close to said mouthpiece; and plural tubing means, one for each of said outlet branches, each of said tubing means having a proximal end opening to its associated said outlet branch and an open-ended distal end, said mouthpiece and said inlet branch forming with each of said outlet branches a separate horn having a predetermined effective air column length, the effective air column length of each of said horns being different from the effective air column length of each other of said horns.

2. The musical wind instrument of claim 1 comprising only a first horn and a second horn.

3. The musical wind instrument of claim 2 wherein the fundamental of said second horn is higher than the fundamental of said first horn by one half tone.

4. The musical wind instrument of claim 3 wherein said tubing means of said second horn has a port adjacent its distal end which may be opened to increase the fundamental of said second horn by one half tone.

5. The musical wind instrument of claim 4 wherein said tubing means of said second horn has a second port adjacent its distal end which may be opened to increase the fundamental of said second horn by approximately one half tone higher than the fundamental of said second horn with said first mentioned port opened.

6. The musical wind instrument of claim 2 wherein the fundamental of said second horn is higher than the fundamental of said first horn by two half tones.

7. The musical wind instrument of claim 6 wherein said tubing means of one of said horns has a port adjacent its distal end which may be opened to increase the fundamental of said one of said horns by one half tone.

8. The musical wind instrument of claim 6 wherein said tubing means of said first horn has a port adjacent its distal end which may be opened to increase the fundamental of said first horn by one half tone.

9. The musical wind instrument of claim 6 wherein said tubing means of each of said horns has a port adjacent its distal end which may be opened to increase the fundamental thereof by one half tone.

10. The musical wind instrument of claim 1 wherein said mouthpiece is constructed to enable one to produce tones by said horns beginning with the fourth harmonic and extending through the twelth harmonic.

11. The musical wind instrument of claim 1 wherein each of said distal ends of said tubing means terminates in a bell.

12. The musical wind instrument of claim 1 wherein one of said distal ends of said tubing means terminates in a straight tube, said instrument having at least one other tubing means terminating at its distal end in a bell.

13. The musical wind instrument of claim 1 wherein at least one of said tubing means has a port adjacent its distal end which may be opened to increase the fundamental of said at least one tubing means by one half tone.

14. The musical wind instrument of claim 1 comprising three horns.

15. The musical wind instrument of claim 14 wherein the fundamental of said second horn is higher than the fundamental of said first horn by one half tone, and the fundamental of said third horn is higher than the fundamental of said second horn by one half tone.

16. The musical wind instrument of claim 15 wherein said tubing means of said third horn has a port adjacent its distal end which may be opened to increase the fundamental of said third horn by one half tone.

17. The musical wind instrument of claim 16 wherein said tubing means of said third horn has a second port adjacent its distal end which may be opened to increase the fundamental of said third horn by approximately one half tone higher than the fundamental of said third horn with said first mentioned port opened.

* * * * *